US006199471B1

(12) United States Patent
Perruzzi et al.

(10) Patent No.: US 6,199,471 B1
(45) Date of Patent: Mar. 13, 2001

(54) METHOD AND SYSTEM FOR DETERMINING THE PROBABLE LOCATION OF A CONTACT

(75) Inventors: Joseph J. Perruzzi, Tiverton, RI (US); John T. Williamson, North Charleston, SC (US); Edward J. Hilliard, Jr., Middletown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/317,089

(22) Filed: May 21, 1999

(51) Int. Cl.[7] ..... F41G 3/00

(52) U.S. Cl. ..... 89/41.01; 89/1.11; 342/62; 342/67; 702/152; 244/3.1

(58) Field of Search ..... 89/41.01, 1.11; 342/67, 62; 702/152; 244/3.1, 3.15

(56) References Cited

U.S. PATENT DOCUMENTS

| | | | | |
|---|---|---|---|---|
| 3,883,070 | * | 5/1975 | Maudlin | 235/61.5 B |
| 4,145,952 | * | 3/1979 | Tye | 89/41 EA |
| 4,146,780 | * | 3/1979 | Sprey | 235/412 |
| 4,148,029 | * | 4/1979 | Quesinberry | 343/9 |
| 4,224,507 | * | 9/1980 | Gendreu | 235/412 |
| 4,739,329 | * | 4/1988 | Ward et al. | 342/119 |
| 4,796,187 | * | 1/1989 | North | 364/423 |
| 5,062,056 | * | 10/1991 | Lo et al. | 364/516 |
| 5,267,329 | * | 11/1993 | Ulich et al. | 382/48 |
| 5,317,319 | * | 5/1994 | Fagarasan et al. | 342/53 |
| 5,319,556 | * | 6/1994 | Bessacini | 364/424.01 |
| 5,365,236 | * | 11/1994 | Fagarasan et al. | 342/53 |
| 5,631,653 | * | 5/1997 | Reedy | 342/62 |
| 6,006,145 | * | 12/1999 | Bessacini | 701/1 |

* cited by examiner

*Primary Examiner*—J. Woodrow Eldred
(74) *Attorney, Agent, or Firm*—Michael J. McGowan; Prithvi C. Lall; Michael F. Oglo

(57) ABSTRACT

The present invention relates to a method and a system for determining a weapon firing strategy for an evading target. The method of the present invention comprises the steps of sensing the motion of the target, analyzing the motion of the target, providing a weapon employment decision aid, determining the evasion region for the target using the weapon employment decision aid and the analyzed motion, visually displaying the evasion region, feeding operator knowledge about the evading target, and generating a representation of the probability of the location of the evading target. The weapon employment decision aid utilizes beta density functions to determine the evasion region. The weapon employment decision aid displays target course and speed in the form of bar graphs and allows the operator to input information about target evasion course and speed and uncertainty levels.

17 Claims, 5 Drawing Sheets

METHOD AND SYSTEM FOR DETERMINING THE PROBABLE LOCATION OF A CONTACT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a system and a method for determining a weapon firing strategy for an evading target, which system and method enable an operator to preset a single weapon against an evading target through the utilization of a man/machine interface which allows the operator to model target evasion schemes.

(2) Description of the Prior Art

Various systems have been used to analyze the motion of a target and to allow a weapon to be directed towards the target. U.S. Pat. No. 3,722,447, for example, illustrates an acoustic homing system for a torpedo. U.S. Pat. Nos. 3,883,070; 4,146,780; and 4,739,329 illustrate non-alerted/non-evading targets and weapon placement systems. None of these systems account for changes in target position as a result of target evasion.

U.S. Pat. Nos. 4,224,507; 4,796,187; 5,062,056; 5,267,329; 5,317,319; and 5,365,236 illustrate target selection and tracking systems, and are incorporated by reference herein. The target localization, tracking and classification information generated by these systems may be used in the system and method of the present invention.

Current systems preset the weapon on an intercept trajectory which assumes the target will not be alerted to the attack. The assumption is not realistic. There is minimal guidance given to combat control system operators for presetting weapons to be launched at evading targets. To increase weapon performance against an evading target, it has been suggested to fire two weapons on a lead/lag firing strategy based upon an intercept solution.

SUMMARY OF THE INVENTION

Accordingly, it is an object of the present invention to provide a more realistic method and system for determining the firing point for a weapon when a target or contact is alerted to the attack.

It is a further object of the present invention to provide a method and system as above which enables an operator to preset a single weapon against an evading target.

It is yet a further object of the present invention to provide a method and system as above which provides for an interactive mechanism for combining apriori knowledge of an evading target with subjective operator knowledge.

The foregoing objects are attained by the method and the system of the present invention.

In accordance with the present invention, a method for determining a weapon firing strategy for an evading target comprises the steps of sensing the motion of the target prior to alertment, analyzing the motion of the target prior to alertment, providing a weapon employment decision aid, determining an evasion region for the target using the weapon employment decision aid and the analyzed motion, visually displaying the evasion region, inputting operator knowledge about the evading target, and generating a representation of the probability of the location of the evading target. The weapon employment decision aid utilizes beta density functions to determine the evasion region, displays target course and speed in the form of bar graphs, and allows the operator to input information about target evasion course and speed and uncertainty levels.

A system for determining a weapon firing strategy for an evading target in accordance with the present invention comprises means for sensing motion of the target prior to alertment, means for analyzing the motion of the target prior to alertment, means for determining an evasion region for the target using the analyzed target motion, means for visually displaying the evasion region, means for inputting operator knowledge about the target, and means for generating a representation of the probability of the location of the evading target.

Other details of the method and system of the present invention, as well as other advantages and objects, are set forth in the following detailed description and the accompanying drawings.

DESCRIPTION OF THE PREFERRED EMBODIMENT(S)

The speed, maneuverability, and sophistication of today's threat platforms make the problem of target localization and tracking increasingly difficult. Moreover, once a target is alerted and begins evasive maneuvers, current tracking techniques have been shown to be inadequate. In locating an evading target, the use of in-situ tactical information together with empirical information can help to concentrate search efforts in regions where the target is likely to be. The present invention relates to an interactive mechanism for combining apriori knowledge of the problem with subjective operator knowledge. The weapon employment decision aid (WEDA) of the present invention accepts heuristic information about an evading target's strategies and transforms this information into data that can be used to specify a target's evasion speed and course. The WEDA is preferably formed from a computer which has been programmed to carry out the functions set forth hereinbelow. The computer forming the WEDA may comprise any suitable computer known in the art.

Figure 1:
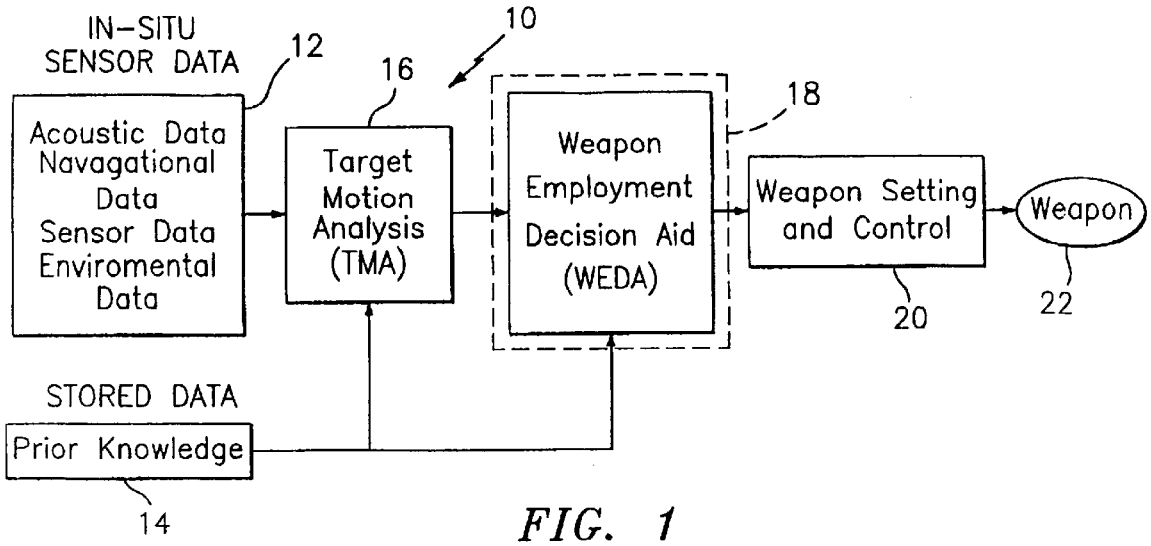
FIG. 1 is a schematic representation of a system in accordance with the present invention.

FIG. 1 illustrates a combat control weapon targeting system 10. As shown therein, the system 10 has two major functions—target motion analysis and weapon setting and control. Onboard sensors 12 provide measurements related to target contacts, own ship and the environment as well as intelligence data depicted in the block 14. The sensors 12 may comprise any suitable sensors known in the art such as acoustic sensors. The target motion analysis block 16 comprises a computer or a portion of a computer which has been programmed to analyze the information received by the sensors 12. As shown in FIG. 1, the block 16 receives information from the stored data block 14 as well as the sensors 12. The block 16 computes estimates of the contact state (bearing, range, course and speed) in a known manner. For example, the block 16 may comprise any of the target motion analysis systems shown in U.S. Pat. Nos. 4,224,507; 4,796,187; 5,062,056; 5,267,329; 5,317,319; and 5,365,236, which are hereby incorporated by reference herein.

The output from the target motion analysis block 16 is fed to the weapon employment decision aid 18 along with stored data from the block 14. The weapon employment decision aid as previously discussed is formed by a computer or a portion of a computer programmed to carry out the functions described hereinafter. The output from the WEDA 18, namely target mean evasion course and target mean evasion speed, is supplied to a weapon setting and control block 20 which communicates with the weapon 22. The weapon setting and control block 20 may comprise any suitable weapon setting and control means known in the art.

It is the purpose of the WEDA 18 to enable the operator to preset a single weapon against an evading target through the utilization of a man/machine interface which allows the operator to model target evasion schemes. The first step in achieving a solution to an evading target problem is for the WEDA to determine the evasion region. Bounding regions for alerted and evading targets have been defined as a function of time based on known target information and characteristics. These regions are pessimistic since they assume that the target travels at maximum speed and turns with a constant minimum turning radius. A more realistic definition of the evasion region can be achieved by using appropriate probability density functions to model the anticipated course and speed changes.

The bounding regions are generated under the assumption that target location and direction prior to alertment are known. After alertment, the target is assumed to be capable of traveling in any direction from present course and at any speed up to maximum. The maximum distance traveled by the target, defined as a radial distance R, is a function of the post-alertment time. Since target maneuvers are unrestricted, R is the radius of a bounding circle that increases with time. This growing circle defines the evasion region and bounds all possible target locations after alertment.

In accordance with the present invention, beta density functions have been developed to model the maneuvering target position as a function of alertment time. In other words, the beta density functions model both the evasion speed and course of the alerted target. It has been found that this is the most comprehensive model since both symmetrical and skewed positional density functions can be generated. For this model, any maneuver results in a position lying within the circular bounding region and the final spectrum of positions distributed over the entire evasion region.

The modeling of any type of evasion tactic is possible simply by choosing the appropriate shaping parameters in the density function. The density function for characterizing the evasion speed is of the form $$f_s = \frac{S^{(a-1)}(S_m - S)^{(b-1)}}{S_m^{(a+b-1)}B(a, b)} \quad 0 \le S \le S_m, \tag{1}$$

where S is the target speed, $S_m$ is the maximum target speed, a and b are shaping parameters, and B(a,b) is the beta function. The density function for the evasion course is given by $$f_\theta = \frac{(\theta + \pi + C_r)^{(c-1)}(\pi + C_r - \theta)^{(d-1)}}{(2\pi)^{(c+d-1)}B(c, d)}, \; C_r - \pi \le \theta \le C_r + \pi \tag{2}$$

where θ is the course change, Cr is the target course before evasion, and c and d are shaping parameters. The resultant positional density function is written as $$f(x, y) = \frac{\sqrt{X^2 + Y^2}^{(a-2)}\left[r_m - \sqrt{X^2 + Y^2}\right]^{(b-1)} [\tan^{-1}(X/Y) + \pi - C_r]^{(c-1)}[\pi + C_r - \tan^{-1}(X/Y)]^{(d-1)}}{r_m^{(a+b-1)}(2\pi)^{(c+d-1)}B(a, b)B(c, d)}, \tag{3}$$

where $r_m$ is the maximum distance the contact can travel based on the evasion time t, or $$r_m = S_m t. \tag{4}$$

Figure 2:
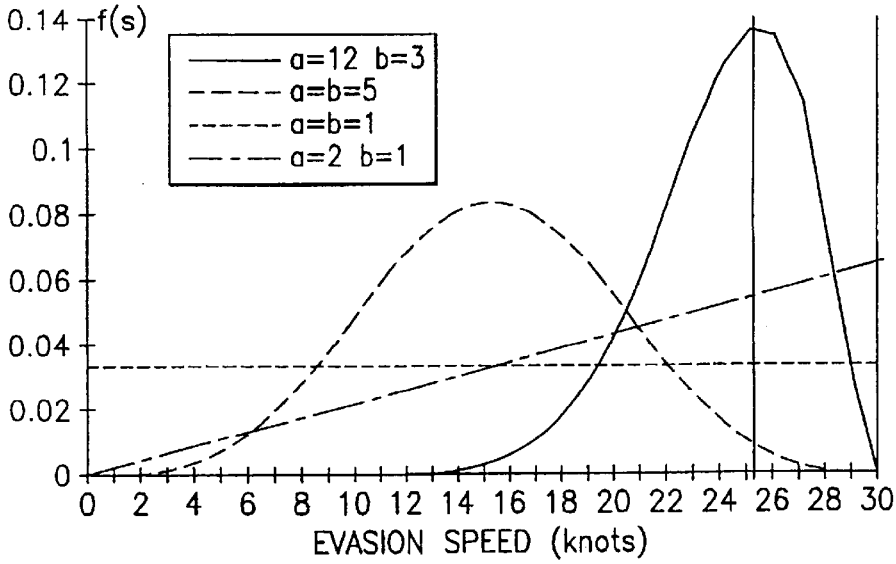
FIG. 2 is a graph showing evasion speed density functions for different shaping parameters.

These particular densities meet all of the requirements stated above. Each one is a one-dimensional, four-parameter function (minimum and maximum values for evasion speed (Smin, Smax) or course (Cmin, Cmax) and two shaping parameters for evasion speed (a,b) or course (c,d)) and can assume widely differing shapes for various values of the shaping parameters. FIG. 2 shows various evasion speed models for different shaping parameters (a,b) for the beta density function. Each one of these density functions represents a possible model of target evasion speed. For example, when a=b=1, a uniform density results, implying that all speeds between zero and Smax are equally likely. The ramp density function (a=2,b=1) would weight more heavily those evasion speeds near the maximum, while the skewed model (a=12,b=3) weights speeds near the maximum in a nonlinear fashion. The symmetrical model (a=b=5) would have a mean evasion speed at sm/2. Similar models for evasion course can be generated through the selection of the shaping parameters c, and d. Thus, an infinite number of possible evasion strategies can be modeled from the beta density functions.

The positional density function developed in the preceding section contains valuable information about evading target characteristics. But for this information to be of any use to an operator, it must be presented in a manner that can be easily understood. A major step in accomplishing this goal is to represent the density functions as target containment regions; that is, transform the three-dimensional information (x, y, and associated probability) into two dimensions where the regions describe the high probability areas. The method employed in the WEDA converts the resultant two-dimensional positional density function into a sectionalized probability map where the probability of the target being in a certain location is displayed as a color intensity. Darker intensities represent higher probabilities of target location (see FIG. 5) This technique is well suited to torpedoes since the problem is a dynamic one; that is, as the torpedo is searching the region, the target is evading, resulting in a time-varying probability region. Because the probability map sectors are much smaller than contour regions, an operator can preset a torpedo to run through the highest probability sector. In addition, this method generates the target containment region quickly, which is very critical in a dynamic situation.

Figure 5:
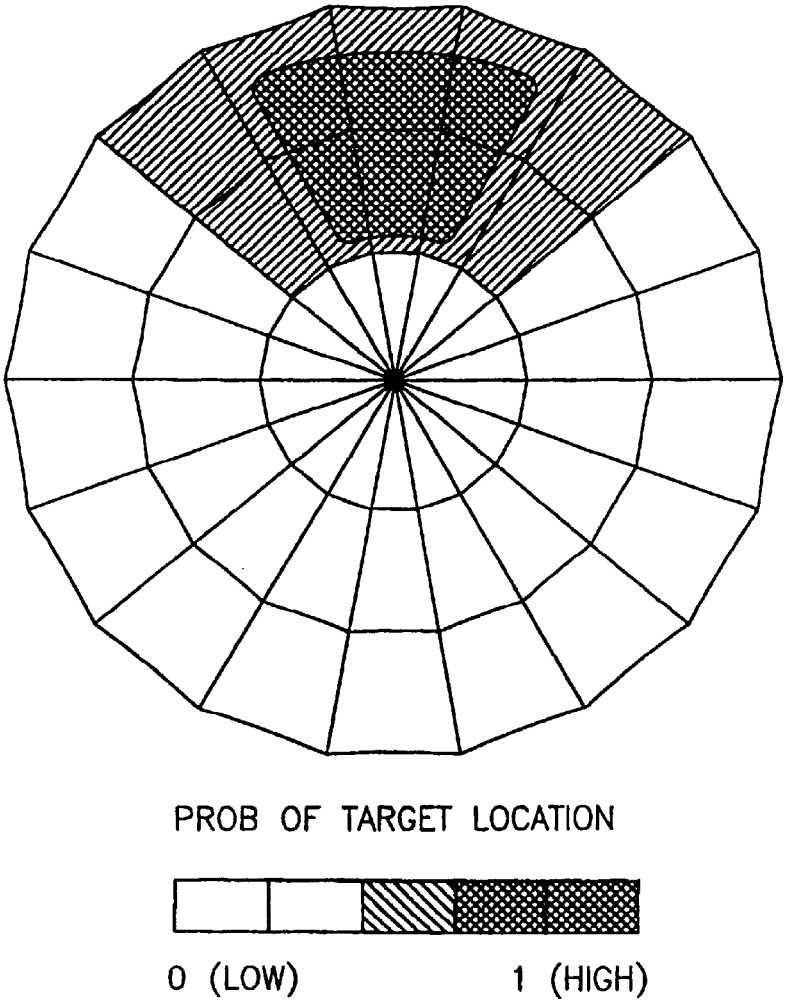
FIG. 5 illustrates a target probability location representation generated by the weapon employment decision aid.

The generation of FIG. 5 involves a number of steps. First a 100-percent containment circle about the current target location is computed. This containment circle is based on the target's maximum evasion speed $S_m$ multiplied by the evasion time t (equation (4)). Next, the containment circle is divided into sectors, the number of which affects computation time and solution resolution. The system may use 200 sectors—10 radial divisions and 20 angular divisions. The probability for each sector is approximated by $$P_{s_i}=[I_{ru_i}(a,b)-I_{rl_i}(a,b)][I_{\theta u_i}(c,d)-I_{\theta l_i}(c,d)], \quad (5)$$

where $ru_i$, $rl_i$, $\theta u_i$, $\theta l_i$ are the radial and angular values of each sector and $I_{rui}$ (a,b); $I_{rli}$ (a,b); $I_{\theta ui}$ (c,d); and $I_{\theta li}$ (c,d) are the incomplete beta functions. All values of $P_{si}$ are displayed in an ordered fashion, the highest probability sector having the darkest intensity and the lowest probability sector having the lightest intensity. This procedure yields a display that allows an operator to quickly identify the most likely evading target location. Such a capability enables the operator to determine the number of weapons required, as well as associated placement coordinates, to effectively cover the target evasion region.

The WEDA 18 is designed to function in a user-friendly manner. The operator uses menus and bar graphs to construct a target evasion region while symbolically accounting for the uncertainty contained within the problem. The main obstacle in the design of the man-machine interface was the development of a scheme that would closely adhere to the operator's concept of the problem while allowing for the inclusion of varying degrees of uncertainty in the target's evasion course and speed. This uncertainty was found to be of a symbolic type that is usually expressed verbally, ranging from "I'm very uncertain as to the target's evasion course" to "I'm very certain the target will evade at course 180°." Such verbal comments indicated that operators typically worked within a finite set of uncertainties. A quantization of the uncertainty spectrum resulted in defining five levels of uncertainty (viz., very uncertain, uncertain, somewhat uncertain, certain, very certain).

After quantitizing the uncertainty levels, a method for mapping the symbolic uncertainty into a probabilistic format that could be computed numerically was developed. Various methods of representing uncertainty were examined from the fields of computer science and artificial intelligence. Analysis indicated that the type of uncertainty mapping being sought was not completely represented in any of the methods examined. Past experience in human factors techniques subsequently led to a graphic representation of the target evasion parameters and associated uncertainties. A bar graph scheme was determined to be a good mechanism for translating an operator's internal concept of target evasion and associated uncertainties into numerical statistical information.

Figure 3:
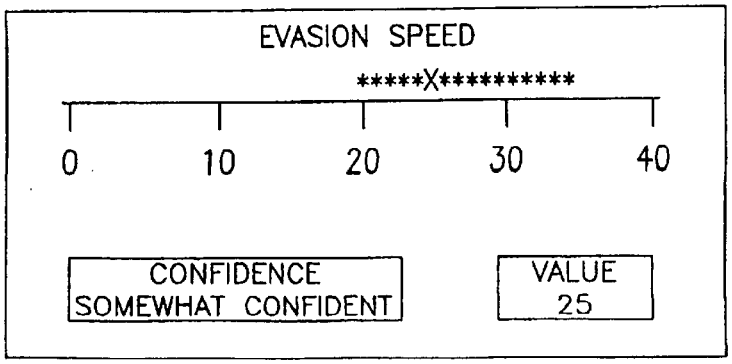
FIG. 3 is a speed bar graph display generated and used by the weapon employment decision aid of the present invention.
Figure 4:
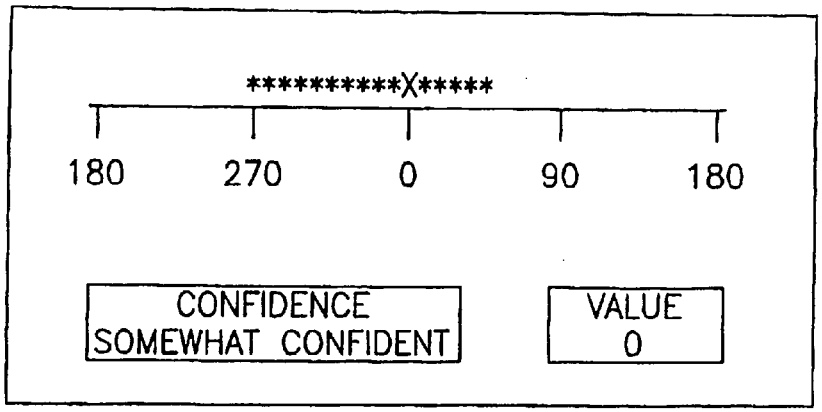
FIG. 4 is a course bar graph display generated and used by the weapon employment decision aid.

The bar graph representation, depicted in FIGS. 3 and 4, uses various symbols as markers to indicate evasion parameters of the target. An X is used to indicate the operator's choice for "most likely evasion value" in both course and speed. Uncertainty in the most likely value is indicated by inserting "padding" (asterisks) on each side of the value. The larger the padding (i.e., the more asterisks), the greater the uncertainty; an absence of padding indicated certainty. As the padding of asterisks is entered, a symbolic description of the current level of uncertainty is displayed to the operator in the window labeled CONFIDENCE.

A mapping algorithm from graphic to statistical representation was developed. The algorithm uses the mean value, standard deviation, and mode of course and speed bar graphs to develop beta density functions containing the same statistics. The first step in conversion requires determination of the mode of the bar graph. This is a straightforward process in which the most likely value represented by X is equated directly to the mode of a beta density function. The mean of the bar graph is computed by an averaging technique, wherein all values indicated by asterisks are summed and then divided by the total number of asterisks. The standard deviation (STDV) of the bar graph is finally computed by taking each value indicated by asterisks, subtracting the mean from it, squaring it, summing all of them, dividing by the total number of asterisks, and finally taking the square root (SQRT).

When the uncertainty is nonsymmetric, the padding of asterisks is unequal about X (see FIGS. 3 and 4). In this case, the resulting density function is skewed, indicating a higher probability of values on the skewed side.

The mode and standard deviation are subsequently used to compute the shaping parameters (a, b, c, d) by employing equations (6) and (7) for speed density and equations (8) and (9) for course density are written below. This results in the solution of a cubic equation in determining the shaping parameters, and yields the target speed and course density functions for this specific evasion tactic.

$$\text{mode}_S=[(a-1)S_m]/(a+b-2), \quad (6)$$

$$\sigma_S=(\sqrt{ab}\ S_m)/[(a+b)\sqrt{a+b+1}], \quad (7)$$

$$\text{mode}_\theta=\{[(c-d)\pi]/(c+d-2)\}+C_T, \quad (8)$$

$$\sigma_\theta=(2\pi\sqrt{cd})/[(c+d)\sqrt{c+d+1}]. \quad (9)$$

The principal advantage to the WEDA 18 is that it allows the operator to enter heuristic knowledge about target evasion course and speed and that it is designed to function in a user-friendly manner. The operator uses menus and bar graphs to construct a target evasion region while symbolically accounting for the uncertainty contained in the problem. The operator may input the evasion course and speed into the WEDA using any suitable means known in the art such as pull-down menus and a keyboard.

The following is an example of the use of the WEDA 18.

This example involves a single target on an initial course of 180° with a current speed of 9 knots. The target is assumed to be alerted when the torpedo enables at a range of 3000 meters from the target. The operator can now construct the target evasion model through interaction with the WEDA. The speed bar graph is used to enter the evasion speed and associated uncertainty. In this case, the operator estimated that the target will evade at 25 knots (see FIG. 3), with a skewed uncertainty indicating higher probabilities of fast evasion speed. The tactical description yields a skewed speed density function with shaping parameters of a=8, b=6. The density function generated with these shaping parameters has approximately 55 percent of its area located between 20 and 28 knots, indicating that this is a good representation of the evasion speed entered. The operator now uses the course bar graph to enter the evasion course and associated uncertainty. Here, the operator estimates that the target will evade on a course of 0° (see FIG. 4), with more probability that the target will turn left rather than right to evade. The resulting skewed course density function has shaping parameters of c=4, d=5 and again closely represents the evasion course entered.

Figure 6:
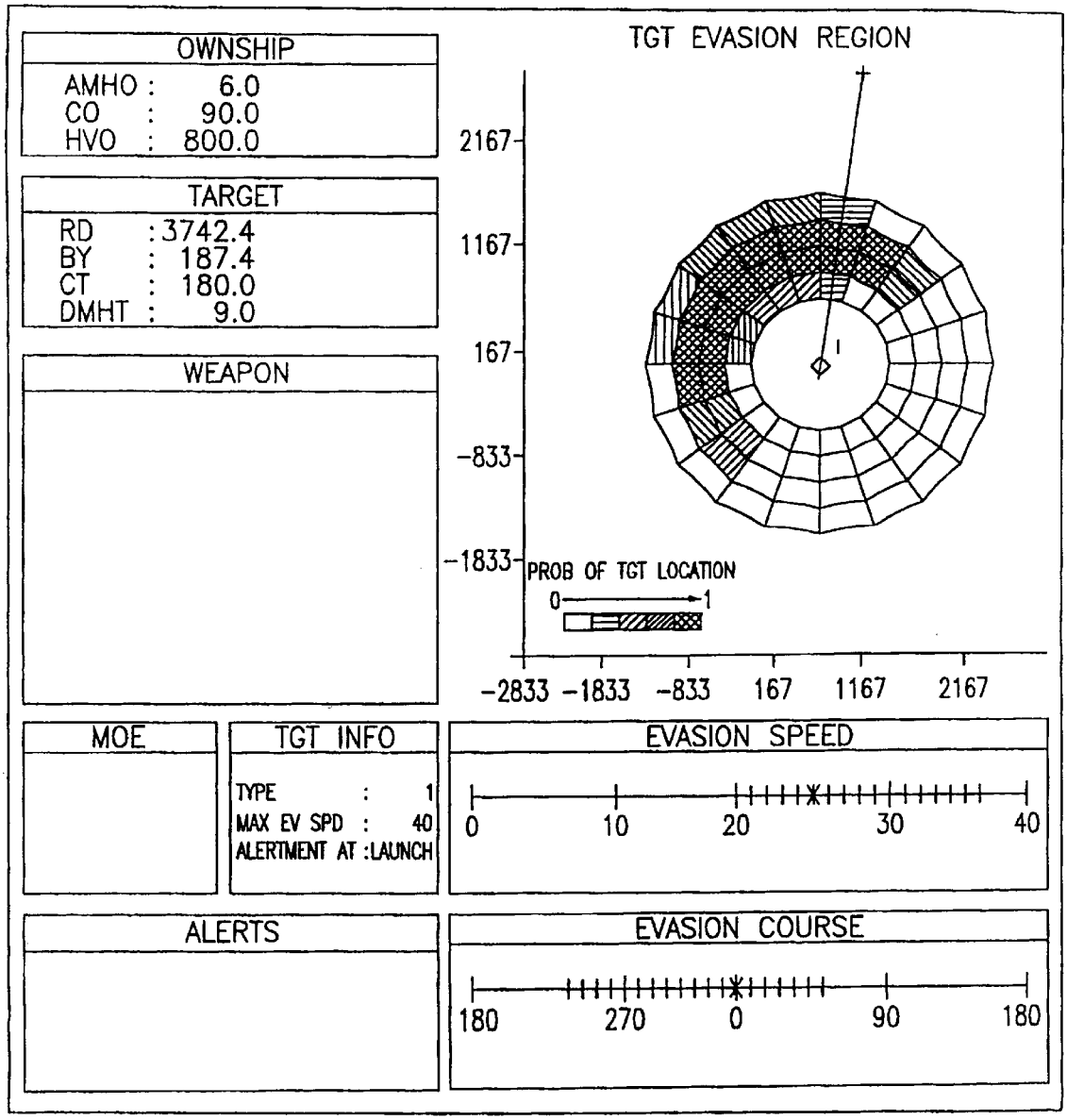
FIG. 6 illustrates a weapon employment decision aid display.

The aforementioned combination of the course and speed density functions results in most probable target positions being located in a sector centered at bearings 300° and a range of 1100 meters beyond current target location. This information is displayed on the WEDA's sectionalized probability map (see FIG. 6). The darker areas indicated higher probabilities of target location.

It has been found that two special cases exist when using the WEDA. The first is when the operator is very uncertain about target evasion course and speed. In this case, both beta density functions begin to approximate uniform densities, exponentially tapering off in the radial direction to zero at the boundary of the 100-percent containment circle. The second special case occurs when the mode of the evasion speed is set equal to the maximum evasion speed and the evasion course is very uncertain. In this case, the speed beta density function approximates a ramp function and the course density function approximates a uniform distribution inside the 100 percent containment circle.

Figure 7:
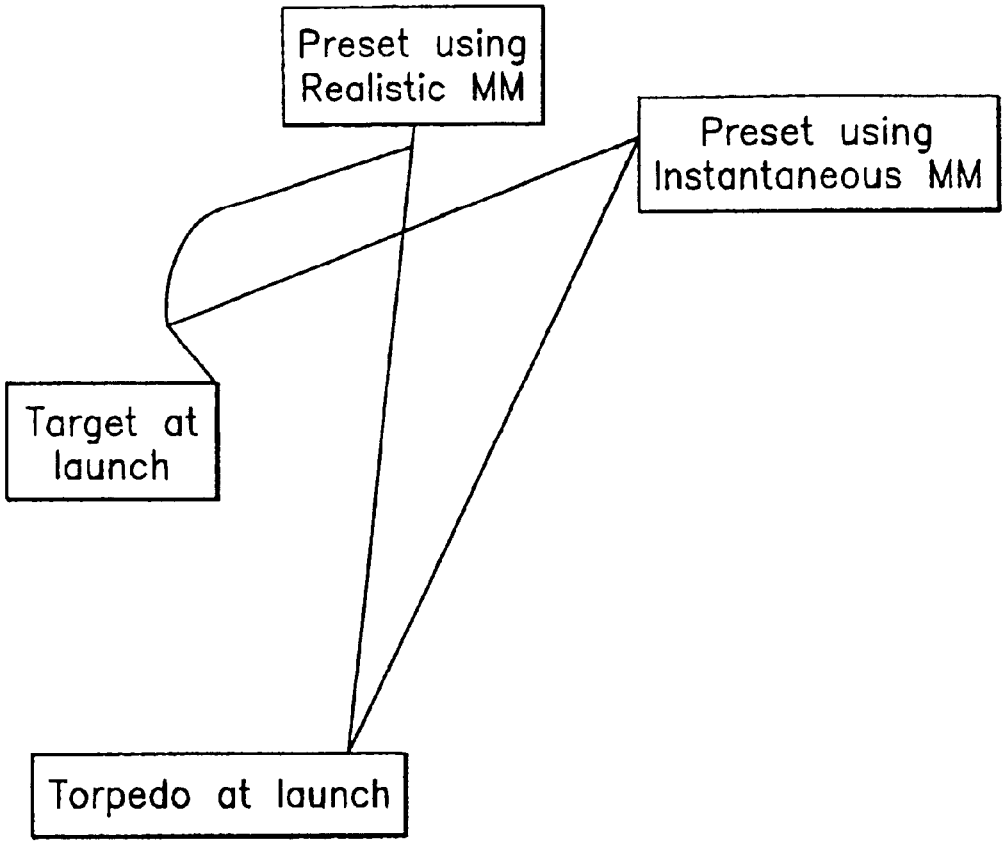
FIG. 7 illustrates a representation of a torpedo run preset from instantaneous and realistic target motion models.

It has been found that when the WEDA is employed on a submarine, the accuracy of the weapon firing point is contingent upon the fidelity of the submarine motion models which generate the target location region. These regions are a function of submarine classification (i.e. diesel, SSN, SSBN, etc.) as well as the initial submarine velocity before evasion. The regions that are generated in WEDA employ a simple motion model that only characterize submarine classification by using the maximum speed. The end result is circular regions which only vary in size from submarine to submarine by the radius. Thus, a more sophisticated motion model may be incorporated into WEDA which models the acceleration of the submarine for both speed and course changes. This motion model employs target characteristics such as turn rate, turning radius and acceleration for various submarine classes in the computation of the mean evasion course and speed. The firing point for this region would also be different from that shown in FIG. 5. FIG. 7 shows two sets of weapon presets one using the instantaneous motion model and the other using the realistic motion model. As can be seen, there is a significant difference in the torpedo run.

Table 1 shows the different weapon presets (gyro angle, run distance and run time) for the improved version for the same two different submarine types in Table 1. Parameters for each submarine are selected as a function of classification which results in regions that are very accurate for that contact.

TABLE 1

WEDA presets using the realistic motion model

| SUBMARINE TYPE | EVASION COURSE | EVASION SPEED | TOTAL WEAPON RUN | WEAPON COURSE |
|---|---|---|---|---|
| SSN | 45 DEG | 20 YDS/SEC | 3985 YDS | 37.3 DEG |
| SSBN | 45 DEG | 12 YDS/SEC | 3786 YDS | 37.1 DEG |

Since these parameters are inputs to the weapon order generation (WOG) algorithm, the resulting presets are also different. The value added in using the WEDA algorithm presented in this patent application can be demonstrated employing a Monte Carlo simulation. Four targeting solutions were evaluated using this simulation and the results are shown in Table 2.

TABLE 2

Probability of Acquisition for different weapon presets

| | SSN/WEDA REALISTIC MM | SSN/WEDA INSTAN MM | SSBN/WEDA REALISTIC MM | SSBN/WEDA INSTAN MM |
|---|---|---|---|---|
| PROBABILITY OF ACQUISITION | 80 | 70 | 95 | 87 |

Figure 8A:
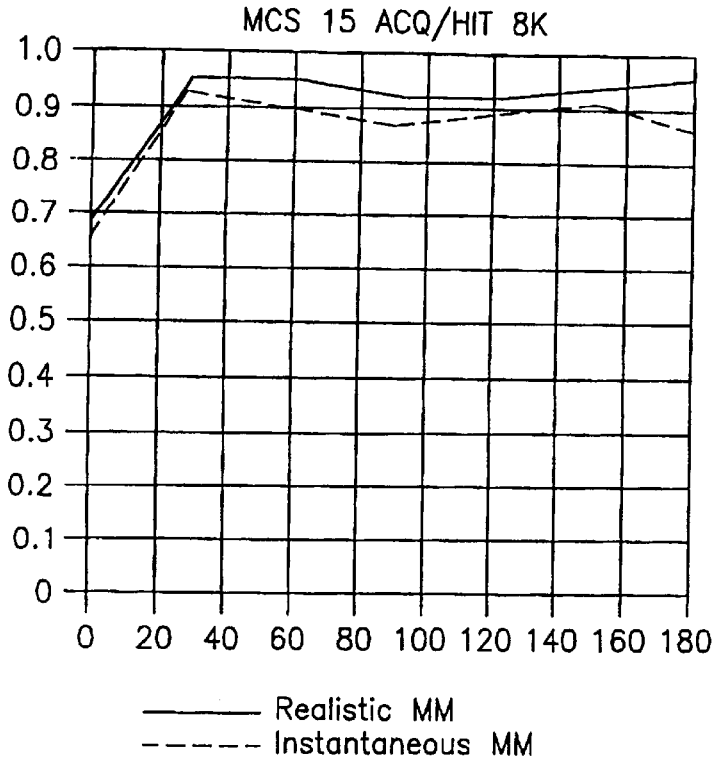
FIGS. 8A and 8B are graphical comparisons of presetting with realistic and instantaneous motion models (MM).
Figure 8B:
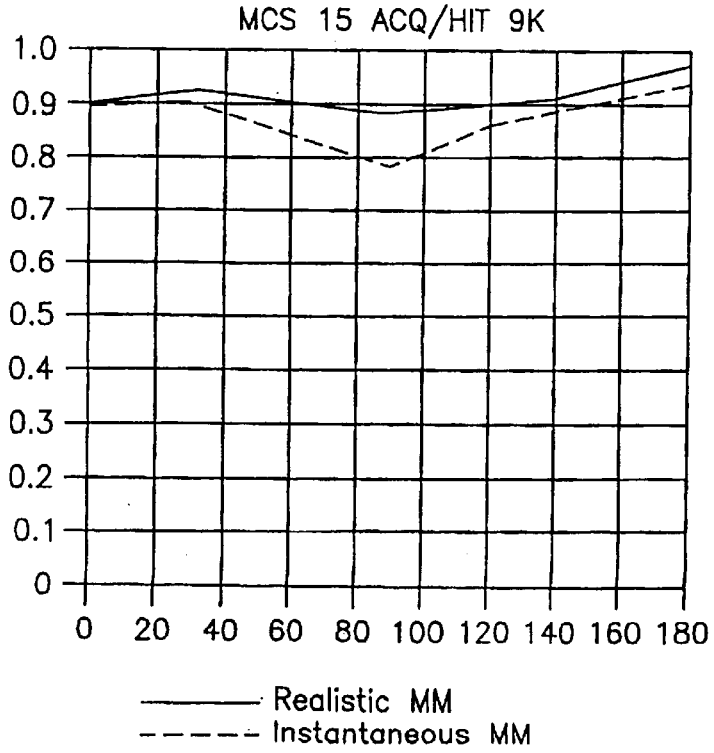

Table 2 shows the importance of using the more realistic target kinematics model in the determination of the firing solution. There is at least a 10% increase in torpedo acquisition using the evasion parameters from the realistic MM over the instantaneous MM. FIGS. 8A and 8B further support this by comparing probability of acquisition for a torpedo preset with the two motion models.

Summarizing, this added feature results in improved firing points for advanced weapons. The real time performance of WEDA has not been diminished and overall weapon performance has improved by it.

It is apparent that there has been provided in accordance with the present invention a method and a system for determining the probable location of a contact which fully satisfies the means, objects and advantages set forth hereinbefore. While the present invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method for determining a weapon firing strategy for an evading target comprising the steps of:

sensing motion of said target;

analyzing said motion of said target;

providing a weapon employment decision aid;

determining an evasion region for said target using said weapon employment decision aid and said analyzed motion;

visually displaying said evasion region;

feeding operator knowledge about said target; and generating a representation of the probability of the location of said target.

2. The method of claim 1 wherein said evasion region determining step comprises statistically modeling characteristics of both target course and speed during an evasive maneuver using beta density functions.

3. The method of claim 2 wherein said statistical modeling step comprises using a uniform density function.

4. The method of claim 2 wherein said statistical modeling step comprises using a ramp density function.

5. The method of claim 2 wherein said statistical modeling step comprises using a skewed density function.

6. The method of claim 1 wherein said target motion analyzing step comprises analyzing target location and direction prior to alertment.

7. The method of claim 1 wherein said operator knowledge input step comprises feeding operator knowledge about evasion course and speed.

8. The method of claim 7 wherein the operator further inputs quantitized uncertainty information about said evasion course and speed.

9. The method of claim 1 wherein said representation generating step comprises generating a sectionalized probability map where the probability of a target being in a certain location is displayed as a color intensity.

10. The method of claim 1 further comprising:

determining a shooting solution from said representation of the probability of the location of said target; and inputting said shooting solution into a weapon setting and control system.

11. A system for determining a weapon firing strategy for an evading target comprising:

means for sensing motion of said target;

means for analyzing said motion of said target;

means for determining an evasion region for said target using said analyzed motion;

means for visually displaying said evasion region;

means for inputting operator knowledge about said target; and means for generating a representation of the probability of the location of said target.

12. The system according to claim 11 wherein said evasion region determining means comprises means for statistically modeling characteristics of both target course and speed during an evasive maneuver using beta density functions.

13. The system according to claim 11 wherein said evasion region displaying means comprises means for displaying bar graphs of target speed and course.

14. The system according to claim 11 wherein said operator knowledge inputting means comprises means for feeding operator knowledge about evasion course and speed.

15. The system according to claim 14 wherein said operator knowledge input means further comprises means for inputting quantitized uncertainty information.

16. The system according to claim 11 wherein said means for generating said representation of the probability of the location of said target comprises means for generating a sectionalized probability map where the probability of said target being in a certain location is displayed as a color intensity.

17. The system of claim 11 further comprising means for inputting said weapon firing strategy into a weapon setting and control system.

* * * * *